US006814661B2

(12) United States Patent
Jardinier

(10) Patent No.: US 6,814,661 B2
(45) Date of Patent: Nov. 9, 2004

(54) AIR EXTRACTION FAN

(75) Inventor: Pierre Jardinier, Gournay sur Marne (FR)

(73) Assignee: Conseils Etudes et Recherches en Gestion de l'Air, Bussy Saint Georges (FR)

( * ) Notice: Subject to any disclaimer, the term of this patent is extended or adjusted under 35 U.S.C. 154(b) by 0 days.

(21) Appl. No.: 10/477,184

(22) PCT Filed: May 21, 2002

(86) PCT No.: PCT/FR02/01706

§ 371 (c)(1),
(2), (4) Date: Jan. 29, 2004

(87) PCT Pub. No.: WO02/095298

PCT Pub. Date: Nov. 28, 2002

(65) Prior Publication Data

US 2004/0132400 A1 Jul. 8, 2004

(30) Foreign Application Priority Data

May 22, 2001 (FR) ..... 01 06738

(51) Int. Cl.[7] ..... F24F 7/06

(52) U.S. Cl. ..... 454/341; 415/208.5; 415/211.2; 454/345; 454/356

(58) Field of Search ..... 454/16, 341, 345, 454/356; 415/211.2, 208.5, 208.2

(56) References Cited

U.S. PATENT DOCUMENTS

| | | | | | |
|---|---|---|---|---|---|
| 1,958,145 | A | * | 5/1934 | Jones | 96/230 |
| 2,397,171 | A | * | 3/1946 | Troller et al. | 417/368 |
| 3,329,415 | A | * | 7/1967 | Cowan | 432/222 |
| 5,246,339 | A | * | 9/1993 | Bengtsson et al. | 415/208.1 |
| 5,785,495 | A | * | 7/1998 | Springer et al. | 415/221 |
| 2003/0152459 | A1 | * | 8/2003 | Gliebe | 415/211.2 |

FOREIGN PATENT DOCUMENTS

| | | |
|---|---|---|
| CH | 399 698 | 9/1965 |
| FR | 2 782 781 | 3/2000 |
| GB | 1160136 | 7/1969 |

* cited by examiner

*Primary Examiner*—Harold Joyce
(74) *Attorney, Agent, or Firm*—Oliff & Berridge, PLC

(57) ABSTRACT

A ventilator comprising a cylindrical housing the intake of which is connected to a coaxial cylindrical conduit of smaller diameter, an electric motor axially mounted in the housing, of small diameter relative to that of the housing, and on the shaft of which is fixed a wheel consisting of blades, each having a shape that all the cross-sections of a blade through planes parallel to the axis of the housing are parallel to said axis and the vanes orienting the air stream, integral with the inner side of the housing, distributed at the periphery of the housing and each including at least a curved part which, located on the side of the housing intake, is housed in an annular space comprised between the housing and the virtual cylindrical surface extending the air intake.

8 Claims, 2 Drawing Sheets

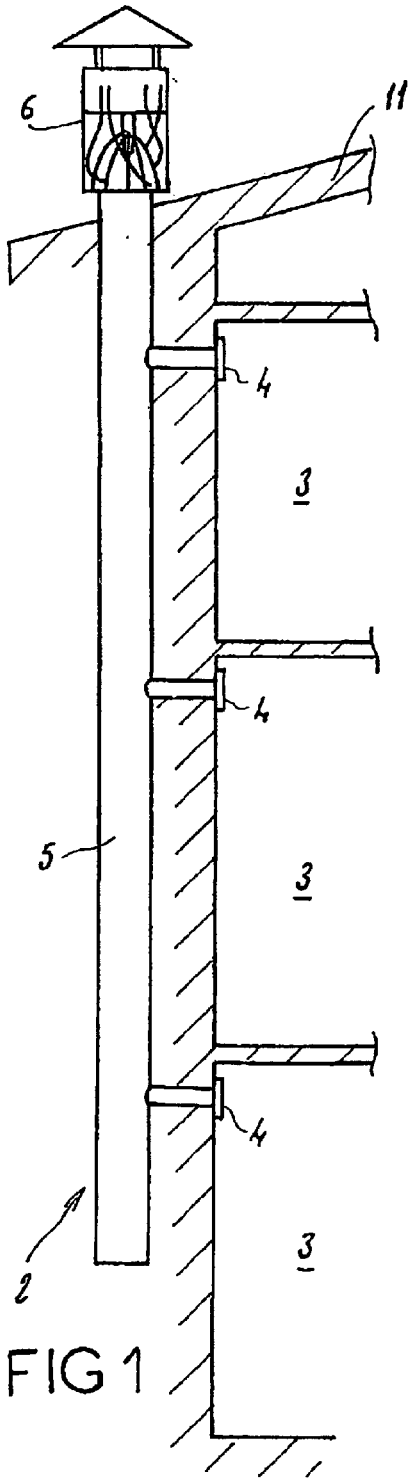
FIG 1
FIG 3
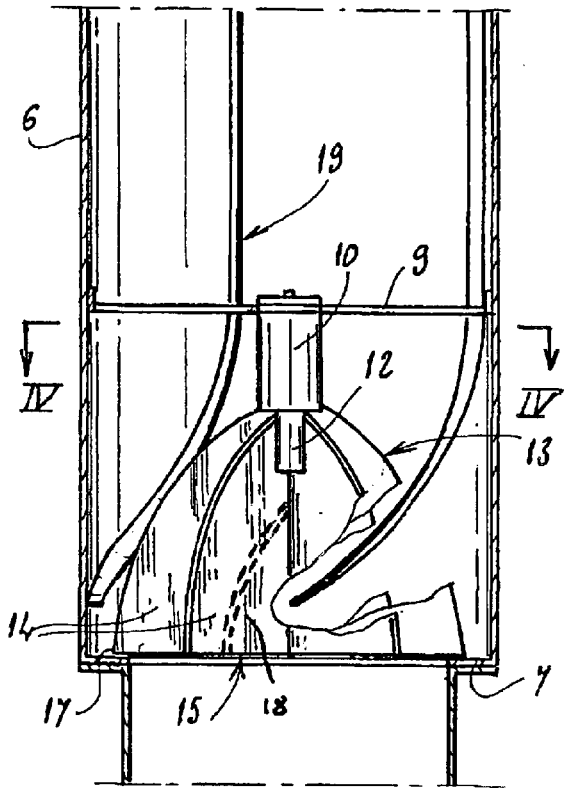
FIG 4
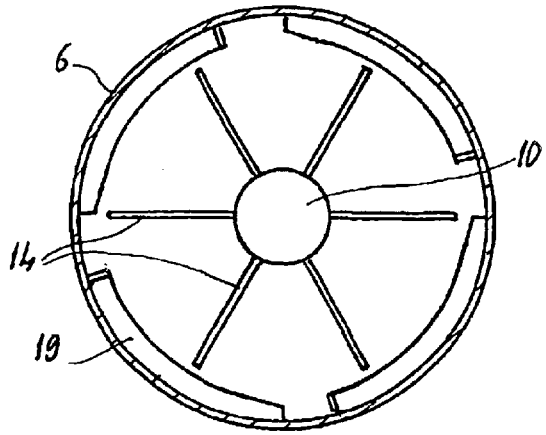

AIR EXTRACTION FAN

The present invention relates to a fan designed to be associated with a duct for extracting air from at least one room, to provide air renewal in the room.

Many rooms, whether used for living accommodation or for offices, have devices providing air renewal, with the purpose of keeping the rooms in good condition, since they must be ventilated to ensure that their constituent materials retain their properties, and also for the purpose of providing comfort for the occupants.

Present-day rooms are generally provided with controlled mechanical ventilation installations, such installations comprising an extraction unit designed to extract a certain volume of air from rooms containing sanitary and cooking facilities, such as kitchens, bathrooms, toilets, etc., an equivalent volume of air to that which has been extracted being admitted into living accommodation such as lounges or bedrooms through air intakes provided in these rooms, in the window frames for example.

Another solution, implemented particularly in older buildings, consists in the provision of an air outlet in the sanitary and cooking rooms leading to a duct with a large cross section, opening at roof level, the air being extracted by natural draft when the motive pressure due to the wind and to thermal circulation is sufficient, for example when this motive pressure is greater than that generated by the combined action of a temperature difference of 10° C. between the interior and the exterior of the rooms and a wind of 3 m/s. The natural draft can provide satisfactory results in winter when the external temperature is significantly higher than the temperature inside the room. However, in the summer there may be a temperature inversion, causing air to circulate in the reverse direction, in other words with air entering through the duct normally used for extraction.

It may therefore be useful to associate this duct with a fan, to provide a supplementary motive pressure when the natural draft is insufficient, particularly in the summer, by using an axial fan having a plurality of blades extending outward from the fan shaft, these blades having an inclination which causes a displacement of air. However, a considerable amount of motive power must be provided to drive the fan, and, when the fan is stationary to permit air renewal by natural draft, the blades create a significant pressure drop which considerably limit the flow of extracted air.

The object of the invention is to provide a fan designed to be associated with an air extraction duct whose structure is such that the fan creates only negligible pressure drops when it is stationary, thus permitting air extraction by natural draft, and which, when in operation, provides an air flow comparable to that obtained with a normal natural draft corresponding, for example, to a temperature difference of 15° C. between the interior and the exterior and a wind speed of 4 m/s, while having very low electricity consumption, thus enabling it to be supplied, if required, by a solar panel placed on the roof beside the fan. The object of the invention is therefore to provide an installation which runs permanently on natural energy, in other words the motive pressure due to the wind and to thermal circulation, particularly in the winter and in the intermediate seasons, and on solar energy which supplies the fan motor in the summer.

For this purpose, the The fan as claimed in the invention comprises:

- a cylindrical shell whose inlet is connected to a coaxial cylindrical duct of smaller diameter by a radial shoulder;
- an electric motor mounted axially in the shell, and having a small diameter in relation to that of the shell, an impeller consisting of blades being fixed on the motor shaft, each blade being shaped in such a way that all the cross sections of one blade in planes parallel to the axis of the shell are parallel to the said axis, the maximum diameter of the blades being between the diameter of the shell and that of the inlet of the shell and decreasing in the downstream direction, in other words from the inlet end to the other end, and
- air guide vanes, integral with the inner surface of the shell, distributed over the periphery of the shell and comprising in each case at least one curved part which, being located at the inlet end of the shell, is housed in the annular space between the shell and the virtual cylindrical surface which extends the air inlet.

Because of the shape of the blades of the fan impeller, these blades offer only a very low resistance to the flow of air and generate only small pressure drops when the motor is stopped. As regards the guide vanes, their curved part is located in an area outside the flow of air, since the inlet surface of the shell is smaller than the surface of the shell. However, the The fan as claimed in the invention is highly effective when the electric motor drives the impeller, since the air moved by the impeller strikes the guide vanes which channel the air from upstream to downstream. The efficiency of this fan is very high and its consumption is low, enabling the motor to be supplied with solar energy.

In one embodiment of this fan, each blade is flat and is contained in a longitudinal plane including the axis of the shell.

In a possible embodiment, each blade has an inlet edge which is perpendicular to the axis of the shell and is extended from the point of the outlet edge of the blade located farthest upstream.

The outlet edge of each blade is at a maximum distance from the axis of the shell at the level of its junction with the inlet edge, and then follows a curve which, in the downstream direction, progressively approaches the axis of said shell.

In such a case, the surface area of each blade decreases in the downstream direction.

In another possible embodiment, each blade has an inlet edge perpendicular to the axis of the shell, which extends from the point of the outlet edge of the blade located farthest upstream over a part of the radius of the shell, this edge being extended by an edge running in the downstream and inward direction, thus delimiting a blade in the general shape of a half-crescent.

Thus it is possible to have a blade whose width increases in the downstream direction.

According to another characteristic of the invention, the upstream end of each guide vane is located in the proximity of the path of the upstream parts of the outlet edges of the blades, each vane having a curved part, in other words a part not extending axially with respect to the shell, and having an angle of attack whose orientation is similar to that of the air jets emerging from the blades of the impeller, and being located outside the main flow in natural draft conditions when the fan is stationary, and extending, for example, over a length approximately equal to the diameter of the inlet of the shell, each curved part being extended in the downstream direction by a flat part parallel to the axis of the shell.

It should be noted that, in natural draft conditions, the flow of air, which at the level of the inlet occupies the cross section of the inlet, is broadened only slightly downstream, over a distance equal to the diameter of the inlet. Therefore the curved parts of the guide vanes cause practically no perturbation of the air flow. Beyond this distance, the air flow is in contact with parts of vanes which are parallel to it and which resist it only to a negligible degree. At this level, the vanes can also be wider and their inner sides can enter the virtual cylinder located in the extension of the inlet of the shell.

In any case the invention will be clearly understood from the following description which refers to the attached schematic drawing representing, without restrictive intent, an embodiment of this fan.

FIG. 1 is a highly schematic view of a building equipped with a ventilation duct fitted with this fan;

FIG. 3 is a view in longitudinal section;

FIG. 4 is a view in cross section along the line IV—IV of FIG. 3.

Figure 2:
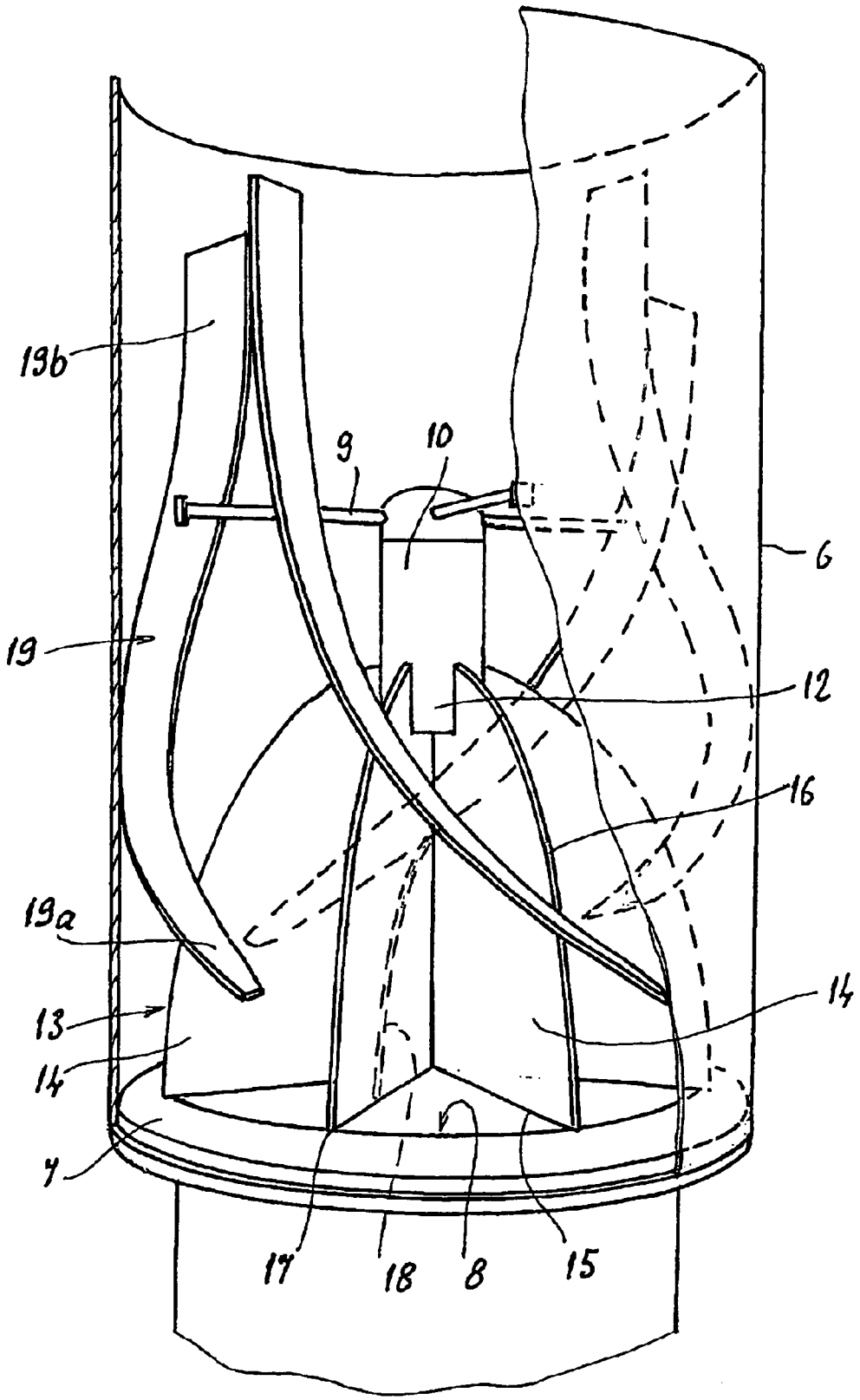
FIG. 2 is a perspective view of the fan.

FIG. 1 represents a building, indicated by the general reference 2, containing a plurality of superimposed rooms 3, each room having at least one outlet 4 communicating with a vertical ventilation duct 5 opening at the level of the roof 11 of the building. The upper part of the duct 5 is connected to a cylindrical shell 6 having a larger external diameter, the inner part of the shell being joined to the duct by a radial shoulder 7. Thus the inlet 8 of the shell, having a cross section identical to that of the duct, is smaller than the cross section of the shell 6. An electric motor 10 having a cross section much smaller than that of the shell is fixed by means of a plurality of radial bars 9 in the shell 6, the diameter of the motor body being, for example, between 10% and 20% of the diameter of the shell. An impeller 13 having a plurality of blades 14 is keyed onto the shaft 12 of the motor, which is central and coaxial with respect to the shell 6. Each blade consists of a flat plate whose inlet edge 15 is perpendicular to the axis of the shell and whose outlet edge 16 progressively approaches the axis of the shell in the downstream direction. It should be noted that the outer end 17 of the inlet edge 15 of each blade 14 faces the radial shoulder 7. The clearance between the edge 15 and the shoulder 7 is as small as possible. In a variant embodiment, each blade has an inlet edge 15 with an outer part perpendicular to the axis of the shell which is extended by another part following, in the downstream direction, the curved line 18 represented in FIGS. 2 and 3, thus forming a blade in the general shape of a half-crescent whose width can increase in the downstream direction.

Guide vanes 19 for the air flow are fixed on the walls of the shell 6, facing the impeller and downstream from it. Each vane 19 has a first part 19*a* extending to a distance from the inlet 8 which is approximately equal to the diameter of the inlet. This part 19*a* of the vane, which is contained in the space delimited by the cylindrical shell 6 and a virtual cylinder extending the inlet 8 of the shell, is curved and has an angle of attack whose orientation is similar to that of the air jets emerging from the blades of the impeller. This part 19*a* is extended in the downstream direction by a flat part 19*b* parallel to the axis of the shell.

This device operates in the following way.

In natural draft operation, the flow of air at the inlet of the stationary impeller 13 is parallel to the planes of the blades 14, and the path through said impeller, which does not divert the flow, has a negligible resistance to the passage of the air.

It should also be noted that, because of its inertia, the air flow which occupies the whole inlet cross section does not undergo significant expansion until it is downstream of the curved parts of the guide vanes. There is practically no contact between the air flow and these vanes except in their flat parts parallel to the axis of the shell, which have only a very low resistance to the flow of the air.

When the fan is in operation, it should be noted that the velocity Vs of the air flow at the impeller outlet is similar to the resultant of the inlet velocity Ve and the impeller rotation velocity Vr at the level of its outlet point.

The impeller can exert a dynamic pressure on the air of this flow with a kinetic energy equal to $0.5\times\rho\times Vr^2$ where $\rho$ is the density of the air.

As the distance from the axis of the shell increases, the velocity Vr also increases, the dynamic pressure exerted on the air is intensified, and the orientation of the air is diverted increasingly toward the walls of the shell.

The intake guide vanes 19*a* channel the fastest peripheral air jets leaving the impeller 13, to progressively convert their rotary movement into a longitudinal displacement which increases the useful output and pressure provided by the fan. These guided flows which have the strongest dynamic pressures share part of their energy with the flows emerging from the parts of the impeller closest to its axis, and by induction cause them to occupy the whole passage surface of the shell in a more uniform way.

It should be noted that the diameter of the impeller 13 decreases in the downstream direction to promote the circulation of the air in the desired direction. The upstream part, having a larger diameter, exerts more pressure on the air than the downstream part. This arrangement also makes it possible to increase progressively the path provided between the impeller 13 and the shell 6 to adapt it to the increasing quantity of air emerging from the impeller as the distance from its inlet 8 increases.

The path through the impeller 13 and consequently the time for which it acts on the air increase in length as the axis is approached. The velocity at which the air is driven therefore becomes closer to the velocity of the impeller as the axis is approached. This solution attenuates the pressure differences between the peripheral parts and the central parts which might generate parasitic return flows.

As the foregoing description shows, the invention greatly improves the prior art by providing a fan having a simple structure, in which the blades cause only a small pressure drop and the curved parts of the guide vanes are outside the air flow when the fan is stationary. It is therefore possible to provide air extraction by natural draft when the temperature and wind conditions permit. When the temperature and wind conditions do not create sufficient natural draft, the fan can provide air extraction with a very low electricity consumption, making it possible to supply the electric motor with solar energy.

Clearly, the invention is not limited to the embodiment of this fan described above by way of example, but includes all variant embodiments. Thus, in particular, it would be possible for the shapes of the blades to be different, and for each blade not to be flat, without thereby departing from the scope of the invention.

What is claimed is:

1. A fan designed to be associated with a duct for extracting air from at least one room, to provide air renewal in the room, comprising:

a cylindrical shell whose inlet is connected to a coaxial cylindrical duct of smaller diameter by radial shoulder;

an electric motor mounted axially in the shell, and having a small diameter in relation to that of the shell, an impeller consisting of blades being fixed on the motor shaft, each blade being shaped in such a way that all the cross sections of one blade in planes parallel to the axis of the shell are parallel to the said axis, the maximum diameter of the blades being between the diameter of the shell and that of the inlet of the shell and decreasing in the downstream direction, in other words from the inlet end to the other end, and air guide vanes, integral with the inner surface of the shell, distributed over the periphery of the shell and comprising in each case at least one curved part which, being located at the inlet end of the shell, is housed in the annular space between the shell and the virtual cylindrical surface which extends the air inlet.

2. The fan as claimed in claim 1, wherein each blade is flat and is contained in a longitudinal plane including the axis of the shell.

3. The fan as claimed in claim 2, wherein each blade has an inlet edge which is perpendicular to the axis of the shell and is extended from the point of the outlet edge of the blade located farthest upstream to the axis of the shell.

4. The fan as claimed in claim 2, wherein each blade has an inlet edge perpendicular to the axis of the shell, which extends from the point of the outlet edge of the blade located farthest upstream over a part of the radius of the shell, this edge being extended by an edge running in the downstream and inward direction, thus delimiting a blade in the general shape of a half crescent.

5. The fan as claimed in claim 1, wherein the upstream end of each guide vane is located in the proximity of the path of the upstream parts of the outlet edges of the blades, each vane having a curved part, in other words a part not extending axially with respect to the shell, and having an angle of attack whose orientation is similar to that of the air jets emerging from the blades of the impeller, and being located outside the main flow in natural draft conditions when the fan is stationary, and extending, for example, over a length approximately equal to the diameter of the inlet of the shell, each curved part being extended in the downstream direction by a flat part parallel to the axis of the shell.

6. The fan as claimed in claim 2, wherein the upstream end of each guide vane is located in the proximity of the path of the upstream parts of the outlet edges of the blades, each vane having a curved part, in other words a part not extending axially with respect to the shell, and having an angle of attack whose orientation is similar to that of the air jets emerging from the blades of the impeller, and being located outside the main flow in natural draft conditions when the fan is stationary, and extending, for example, over a length approximately equal to the diameter of the inlet of the shell, each curved part being extended in the downstream direction by a flat part parallel to the axis of the shell.

7. The fan as claimed in claim 3, wherein the upstream end of each guide vane is located in the proximity of the path of the upstream parts of the outlet edges of the blades, each vane having a curved part, in other words a part not extending axially with respect to the shell, and having an angle of attack whose orientation is similar to that of the air jets emerging from the blades of the impeller, and being located outside the main flow in natural draft conditions when the fan is stationary, and extending, for example, over a length approximately equal to the diameter of the inlet of the shell, each curved part being extended in the downstream direction by a flat part parallel to the axis of the shell.

8. The fan as claimed in claim 4, wherein the upstream end of each guide vane is located in the proximity of the path of the upstream parts of the outlet edges of the blades, each vane having a curved part, in other words a part not extending axially with respect to the shell, and having an angle of attack whose orientation is similar to that of the air jets emerging from the blades of the impeller, and being located outside the main flow in natural draft conditions when the fan is stationary, and extending, for example, over a length approximately equal to the diameter of the inlet of the shell, each curved part being extended in the downstream direction by a flat part parallel to the axis of the shell.

* * * * *